US006672853B2

(12) United States Patent
Ewald

(10) Patent No.: US 6,672,853 B2
(45) Date of Patent: Jan. 6, 2004

(54) CENTER DRIVEN PRESSURE CLAMPED HYDRAULIC PUMP

(76) Inventor: Dennis G. Ewald, 15950 E. Big Mound Rd., Lindenwood, IL (US) 61049

( * ) Notice: Subject to any disclaimer, the term of this patent is extended or adjusted under 35 U.S.C. 154(b) by 0 days.

(21) Appl. No.: 10/097,475

(22) Filed: Mar. 13, 2002

(65) Prior Publication Data

US 2002/0136657 A1 Sep. 26, 2002

Related U.S. Application Data

(60) Provisional application No. 60/277,576, filed on Mar. 21, 2001.

(51) Int. Cl.[7] ..... F04C 2/18
(52) U.S. Cl. ..... 418/132; 196/206.1
(58) Field of Search ..... 418/70, 132, 196, 418/206.1

(56) References Cited

U.S. PATENT DOCUMENTS 2,728,300 A * 12/1955 Stoermer ..... 418/196
3,077,839 A * 2/1963 Gonfrk ..... 418/206.1
3,966,367 A * 6/1976 Erickson ..... 418/132
4,111,614 A * 9/1978 Martin et al. ..... 418/206.1
4,165,206 A * 8/1979 Martin et al. ..... 418/196
4,846,641 A * 7/1989 Pieters et al. ..... 418/70
5,788,473 A * 8/1998 Buse et al. ..... 418/206.1
6,152,715 A 11/2000 Kaempe et al. ..... 418/132

* cited by examiner

*Primary Examiner*—John J. Vrablik
(74) *Attorney, Agent, or Firm*—Lawrence E. Crowe

(57) ABSTRACT

The problem of aligning the drive shaft of a pressure clamped pump with the output shaft of a drive motor in a hydraulic apparatus is solved through the use of pressure clamped pump having a housing adapted for installation into a cavity and a drive shaft coincident with the center of the housing. The hydraulic apparatus may include piloting features configured to facilitate alignment of the pump drive shaft with the output shaft of a motor used to drive the pump. The pump may include elements for retaining the drive shaft within the pump, and may also include a larger and less restricted inlet than could be achieved in prior pressure clamped pumps. The pump may include pumping means in the form of a gear pump having a single primary gear driving a single secondary gear. The pumping means may alternatively be a gear pump having a single primary gear driving two or more secondary gears. Where the pumping means includes two or more secondary gears, the drive shaft may be coincident with the center of the housing. The primary gear may also have a prime number of teeth to reduce wear.

46 Claims, 6 Drawing Sheets

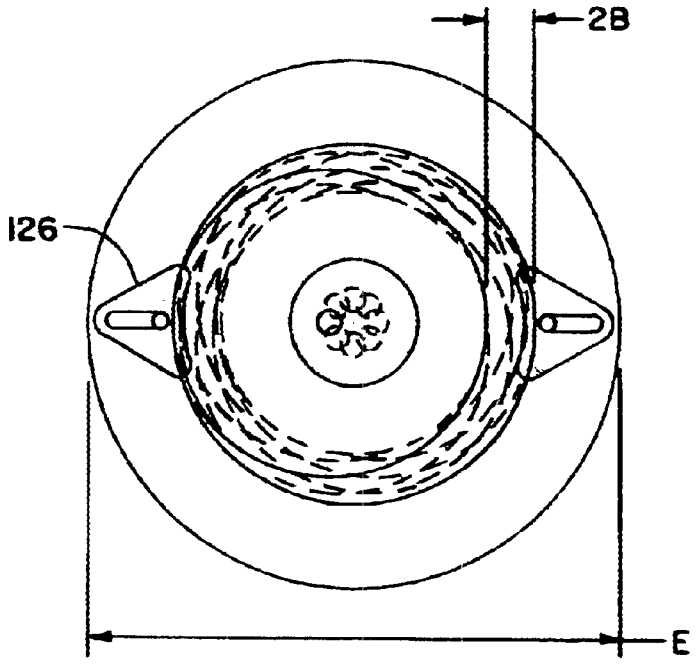
FIG. 4
PRIOR ART
FIG. 8b
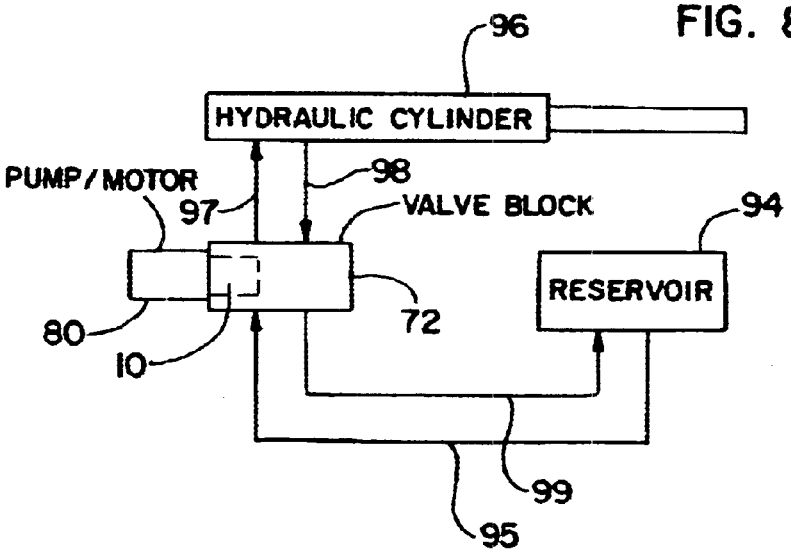

FIG. 8a
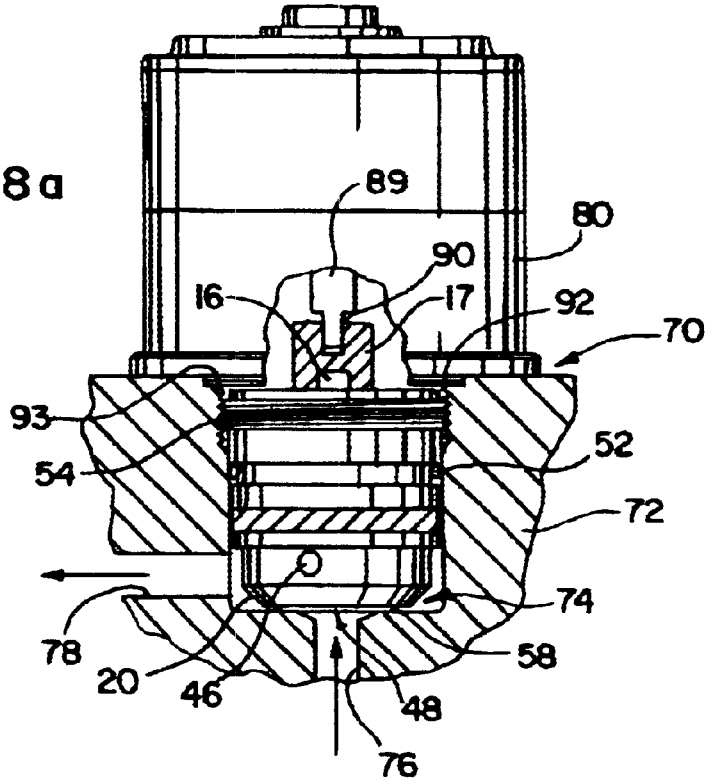
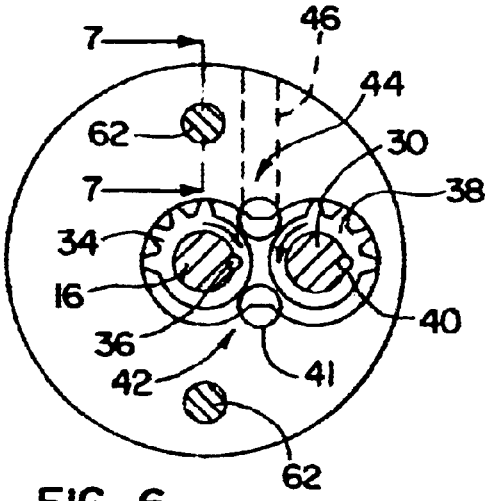
FIG. 6
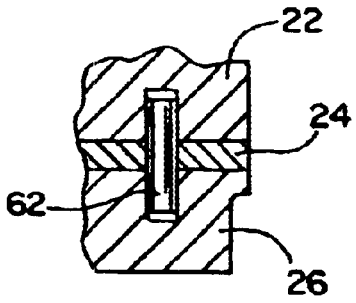
FIG. 7

CENTER DRIVEN PRESSURE CLAMPED HYDRAULIC PUMP

This non-provisional patent application claims the benefit of U.S. Provisional Patent Application Ser. No. 60/277,576, filed Mar. 21, 2001, which is incorporated herein by reference.

TECHNICAL FIELD OF THE INVENTION

This invention relates to hydraulic systems, and more particularly to a hydraulic apparatus including a pressure clamped hydraulic pump.

BACKGROUND OF THE INVENTION

In a hydraulic apparatus including a motor driven pump, it is often desirable to make the component parts as small and highly integrated as possible, so that the apparatus will be compact, light weight, inexpensive to manufacture and maintain, and highly reliable. U.S. Pat. No. 6,152,715 describes a pressure clamped hydraulic pump that is held together by pressure produced in the pump, thereby allowing the elimination of bolts and other fasteners used to hold together pumps of a more conventional design.

Although prior pressure clamped pumps, such as the pump of the '715 patent, provide considerable reduction in size and complexity as compared to more conventional pump designs, further improvement is needed to resolve several problems related to using a pressure clamped pump in a hydraulic apparatus. These problems include difficulty in aligning the drive shaft of the pump with the output shaft of a drive motor, lack of provisions for positively retaining the drive shaft so that it cannot be inadvertently pulled out of the pump, and inherent restrictions on the size of the pump inlet resulting from the structure of prior pressure clamped pumps.

As shown in FIGS. 1–4, The pressure clamped pump 100 of the '715 patent includes a housing 102 having an external threaded portion 104 that engages threads 106 in a cavity 108 of a valve block 110, and a pair of o-ring seals 112, 114 that mate with surfaces of the cavity 108 to seal the inlet and outlet of the pump 100, so that the pump 100 may be installed by simply screwing the pump 100 into the cavity 108 until the seals 112, 114 seat against the surfaces of the cavity 108.

As shown in FIG. 1, the pump 100 includes a drive shaft 116 extending from the upper end of the housing 102. The housing 102 defines a central axis 118 and an outer diameter 'A.' The drive shaft 116 is offset from the central axis 118 by a distance 'B.' This offset 'B' creates several problems in aligning and connecting the drive shaft 116 of the pump 100 to the output shaft 120 of a motor 122 providing rotational force to the drive shaft 116. As shown in FIG. 3, the center of the cavity 108 is coincident with the central axis 118 of the pump 100, as the pump 100 is screwed into and seated in the cavity 108. The offset 'B' of the drive shaft 116 from the central axis 118 results in the center of the drive shaft 116 orbiting in a circular path 124, having a radius equal to the offset 'B,' about the center 118 of the cavity 108, as the pump 100 is screwed into the cavity 108.

Slight dimensional differences in the configurations of the pump 100 and cavity 108, due to inherent manufacturing tolerances and variations in installation torques, result in the drive shaft 116 coming to rest at different positions along the circular path 124, when the seals 112, 114 are fully seated against the surfaces of the cavity 108. Because the position of the drive shaft 116 varies along the circular path 124, the motor 122 must be capable of mounting to the block 110 in any position wherein the drive shaft 116 might come to rest along the circular path 124, so that the output shaft 120 of the motor 122 may be properly aligned to engage the drive shaft 116 of the pump 100. This requires that the motor 122 be mounted to the block 110 with adjustable mounts, such as the pair of clamps 126, so that the output shaft 120 of the motor 122 may follow the drive shaft around the circular path 124 at the radius 'B.'

As a result, even though the motor 122 has a diameter 'C,' the block 110 must be large enough to accommodate a motor footprint 128 having a diameter 'D' equal to the diameter 'C' of the motor 122 plus twice the offset 'B.' To accommodate the mounting clamps 126, the footprint may have to be even bigger, resulting in a valve block 110 having a minimum square or circular profile defining a dimension 'E,' as shown in FIGS. 3 and 4, that is much larger than the diameters of either the pump 100 or the motor 122. Much of the advantage of small size provided by the pressure clamped pump 100 is thus lost due to the offset 'B.'

The offset 'B' also creates other problems. There is no positive means of aligning the output shaft 120 of the motor 122 with the drive shaft 116 of the pump 100. If these shafts are not properly aligned, the misalignment places high stresses on the shafts 120, 116 which may cause the pump 100 and or motor 122 to fail prematurely. In addition, it is not possible to utilize provisions, such as the bolts 130 holding the motor 122 together, to also mount the motor 122 on the block 110, thereby precluding further reduction in size and complexity of the hydraulic apparatus.

As shown in FIG. 1, a pump 100 according to the '715 patent utilizes a series of balls 132 for axially supporting the drive shaft 116 and an idler shaft 134 in the housing 102. Because the drive shaft 116 extends out of the upper end of the housing 102, the drive shaft 116 is supported only on its lower end by one of the balls 132. The drive shaft 116 is keyed to a drive gear 136 of the pump 100, and passes through a shaft seal 138 at the point of exit from the housing 102. Because the drive shaft 116 is supported axially only at the lower end by the ball 132, the drive shaft 116 of prior pressure clamped pumps may be inadvertently pulled out of the drive gear 136 and through the seal 138, thereby rendering the pump inoperative. This may occur, for example, during removal of the drive motor 122, if the motor output shaft 120 has become stuck together with the pump drive shaft 116 during operation, or if the motor 122 is not pulled straight off of the drive shaft 116 along the central axis 118, such that the output shaft 120 becomes canted with respect to the pump drive shaft 116 in a manner that would cause the drive shaft 116 to become wedged together with the output shaft 120 due to the canting of the motor 122.

The lower balls 132 also present an undesirable physical restriction upon the size, shape, and placement of the pump inlet 140, and present difficulties in manufacturing and assembling the pump 100.

SUMMARY OF THE INVENTION

My invention provides an improved hydraulic apparatus and pressure clamped pump that solves one or more of the problems described above through the use of pump having a housing adapted for installation into a cavity and a drive shaft coincident with the center of the housing. In some forms of my invention, the hydraulic apparatus includes piloting features for facilitating alignment of the pump drive shaft with the output shaft of a motor used to drive the pump. The pump may include elements for retaining the drive shaft within the pump, and may also include a larger and less restricted inlet than could be achieved in prior pressure clamped pumps.

In one form of my invention, a hydraulic apparatus includes a block having a cavity adapted for receiving a pressure clamped hydraulic pump. The pump has a central axis and a drive shaft extending along the central axis. The block further includes an inlet channel and an outlet channel, with the inlet channel being adapted for communicating with the cavity and an inlet of the pump, and the outlet channel adapted for communicating with the cavity and an outlet of the pump.

The pump of the hydraulic apparatus may include a housing defining a central axis, an inlet and an outlet. The pump may further include a plurality of pump components positioned in axially disposed relation to one another, and pumping means located in the housing for drawing fluid into the inlet at a first pressure and pumping the fluid from the outlet at a second pressure greater than the first pressure. The pump drive shaft extends from the housing along the central axis and is operatively connected to the pumping means, for drawing fluid into the inlet at a first pressure and pumping the fluid from the outlet at a second pressure greater than the first pressure, when the drive shaft is rotated about the central axis. The housing has a first internal axial area upon which the second pressure acts and a second external axial area greater than the first axial area. The pump inlet and the inlet channel are sealed from the pump outlet and the outlet channel such that the second pressure acts upon the second axial area when the pump is operated and applies a clamping force to the housing components.

The pumping means may be a gear pump having a single primary gear driving a single secondary gear. The pumping means may alternatively be a gear pump having a single primary gear driving two or more secondary gears. Where the pumping means includes two or more secondary gears, the drive shaft may be coincident with the center of the housing. The primary gear may also have a prime number of teeth to reduce wear.

The foregoing and other features and advantages of my invention will become further apparent from the following detailed description of exemplary embodiments, read in conjunction with the accompanying drawings. The detailed description and drawings are merely illustrative of my invention rather than limiting, the scope of the invention being defined by the appended claims and equivalents thereof.

BRIEF DESCRIPTION OF THE DRAWINGS

FIGS. 2–4 are views of a prior hydraulic apparatus including the prior pressure clamped hydraulic pump depicted in FIG. 1, illustrating shortcomings in prior pressure clamped hydraulic pumps;

FIG. 6 is a cross-sectional view of the pump of FIG. 5, taken along lines 6—6 as indicated in FIG. 5;

FIG. 7 is a partial cross-sectional view of the pump of FIG. 5, taken along lines 7—7 as indicated in FIG. 6;

FIG. 8*a* is a partial cross-sectional view of a hydraulic apparatus including the pump of FIG. 5;

FIG. 8*b* is a schematic illustration of a second embodiment of an exemplary hydraulic apparatus including a pressure clamped pump according to my invention;

DETAILED DESCRIPTION

Figure 1:
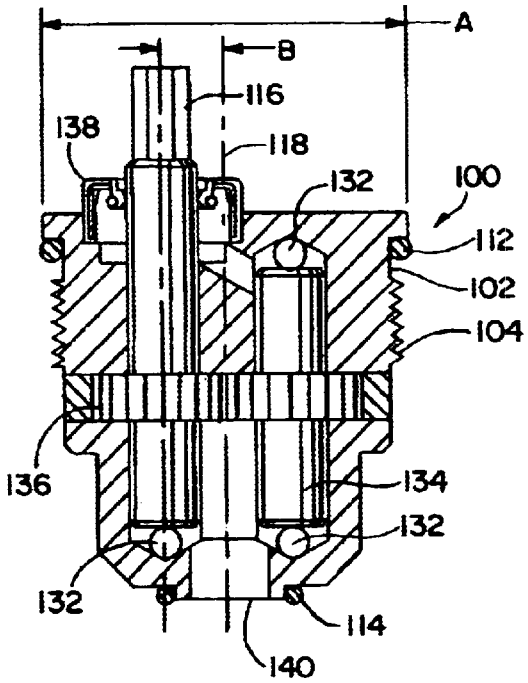
FIG. 1 PRIOR ART
FIG. 1 is a cross sectional view of a prior pressure clamped hydraulic pump.
Figure 5:
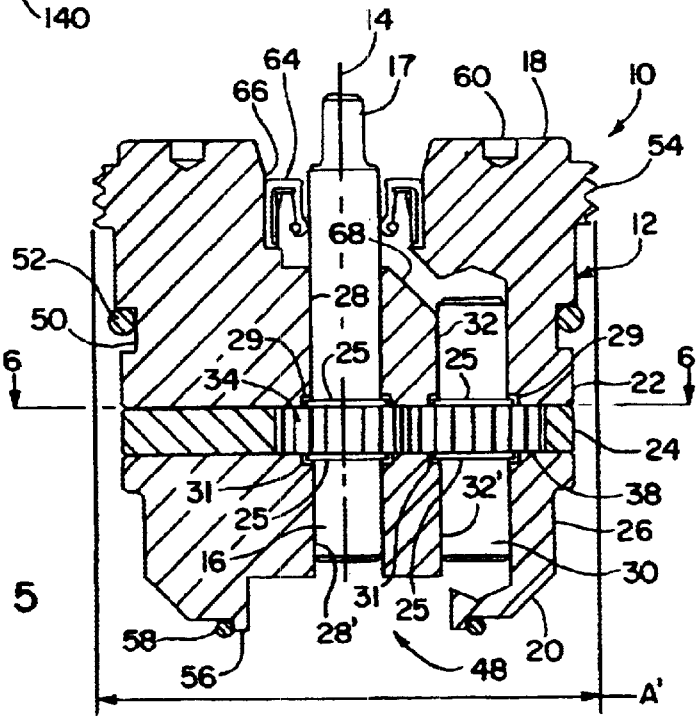
FIG. 5 is a cross-sectional view of a pressure clamped pump having a drive shaft extending along a central axis of the pump housing, according to my invention.
Figure 2:
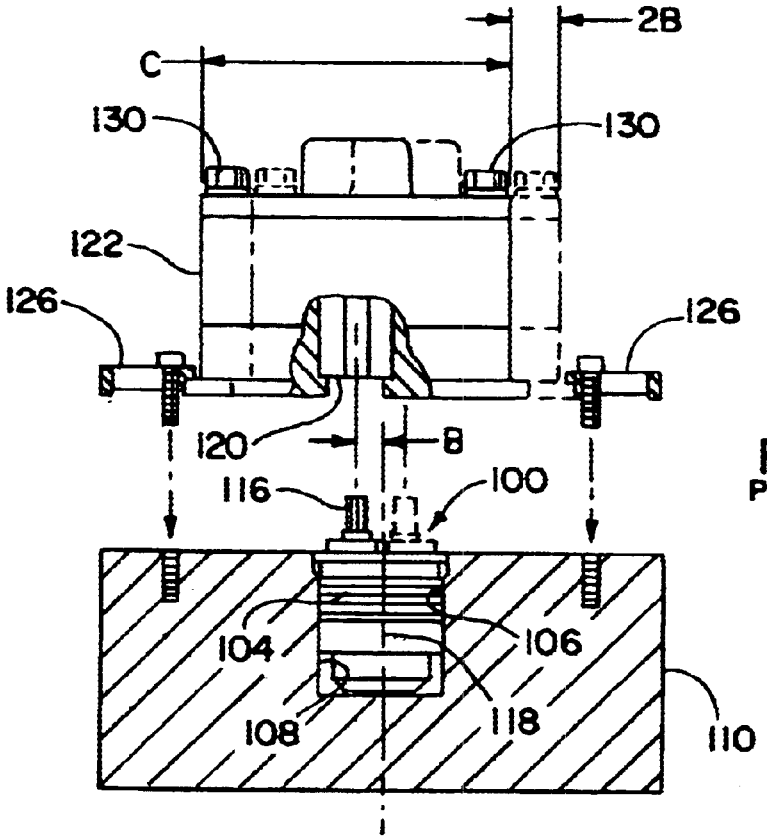
FIG. 2 PRIOR ART
Figure 3:
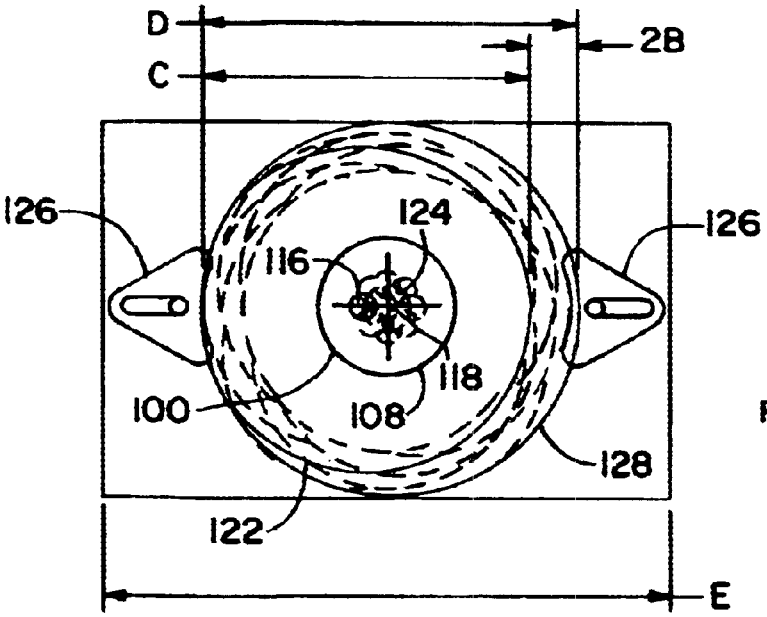
FIG. 3 PRIOR ART

FIGS. 5–7 depict an exemplary pressure clamped pump 10, according to my invention. The pump 10 includes a housing 12, adapted for installation into a cavity, with the housing 12 defining a center, or central axis 14, of the housing 12. The pump 10 includes a drive shaft 16 coincident with the central axis 14 of the housing 12. The distal end of the drive shaft 16 is configured to form a drive connection 17 for connecting the shaft 16 to a drive motor, in a manner described hereinafter in greater detail. The drive connection 17 may take the form of flats on the outer periphery of the drive shaft 16, a slot in the drive shaft 16, a hexagon, or any other suitable shape for drivingly engaging the output shaft of a drive motor. The distal end of the shaft 16 may also be configured to engage a drive connection in the form of drive coupling for connecting the drive shaft 16 to the output shaft of a motor.

The housing 12 is generally cylindrical shaped, and extends from a first end 18 of the housing 12 to a second end 20 of the housing 12 along an axis coincident with the center 14 of housing 12. The first and second ends 18, 20 of the housing 12 may also be referenced hereinafter respectively as the top end 18 and bottom end 20 of the housing 12, with the terms top and bottom end referring to the position of the first and second ends 18, 20 of the housing 12 as depicted in the drawings.

The housing 12 is made up of three pump components in the form of a top or front cover 22, a pump means housing in the form of a gear housing 24, and a bottom or rear cover 26. The drive shaft 16 is rotatably mounted in bores 28, 28' in the front and rear covers 22, 26, respectively. An idler shaft 30 is similarly rotatably mounted in bores 32, 32' in the front and rear covers 22, 26, respectively. The drive shaft 16 and the idler shaft 30 are both retained axially with in the housing 12 by pairs of retaining rings 25 engaging the drive and idler shafts 16, 30 on opposite sides of the gear housing 24. The retaining rings 25 engage the front and rear covers 22, 26 within annular recesses 29, at the lower ends of the bores 28, 32 in the top cover 22, and annular recesses 31 at the upper ends of the bores 28', 32' in the bottom cover 26.

In this exemplary embodiment of my invention, the pump 10 is a gear pump including a primary or drive gear 34 keyed to the drive shaft 16 by a key 36, as shown in FIG. 6. A secondary or driven gear 38 meshes with the drive gear 34 and is keyed to the idler shaft 30 by a key 40.

The bottom end 20 of the rear cover 26 defines a pump inlet 48, as shown in FIGS. 5 and 8*a*, and an axially oriented inlet port 41, shown in dashed lines in FIG. 6, extending from the pump inlet 48 to the inlet side 42 of the gears 34, 38. As the gears 34, 38 rotate in the direction shown by the arrows in FIG. 6, hydraulic fluid is pumped from the pump inlet 48 to the inlet side 42 of the gears 34, 38 via the axial inlet port 41, to the outlet side 44 of the gears 34, 38, and out of a radial outlet port 46 in the rear cover, as shown in FIG. 8*a*, and in dashed lines on FIG. 6.

The outer periphery of the front cover 22 includes an annular groove 50 for retaining an upper o-ring seal 52, and an external thread 54 adapted for engaging an internal thread of a cavity in which the pump 10 is to be mounted. The bottom end 20 of the rear cover 26 includes an annular shoulder 56 extending around the pump inlet 48, for retaining a lower o-ring seal 58, and providing a positive axial stopping surface adapted to bear against a lower surface of the cavity in which the pump 10 to is to be mounted. The top surface 18 of the front cover 22 also includes a pair of tool recesses 60 for receipt of a spanner wrench (not shown) used to screw the pump 10 into the cavity. The purpose of the upper and lower o-ring seals 52, 58, the external thread 54, the shoulder 56, and the tool recesses 60 will be described in more detail below, with reference to FIG. 8*a*.

As shown in FIGS. 6 and 7, the front cover 22, gear housing 24, and rear cover 26 are located with respect to one another by means of dowel pins 62. The number and location of the dowel pins 62 is preferably such that the components will fit together in only one orientation, and two or more dowel pins 62 may be used.

The front cover 22 also includes a shaft seal 64 mounted in a seal pocket 66 for sealing the juncture of the drive shaft 16 and the front cover 22 against leakage. Most of the pressurized hydraulic fluid from the high pressure outlet side 44 of the pump 10 passes through the outlet port 46. Any leakage of fluid within the pump 10 from the high pressure side passes to the low pressure or inlet side 42 of the pump 10, where it is drawn into the gears 34, 38 and re-pressurized. The front cover 22 includes a drain channel 68 for draining any fluid in the seal pocket 66 back to the inlet side 42 of the pump 10.

FIGS. 8*a*–9*c* illustrate a second exemplary embodiment of my invention in the form of a hydraulic apparatus 70 having a block 72 including a bore or cavity 74 adapted for receiving a pressure clamped hydraulic pump 10 having a central axis 14 and a drive shaft 16 extending along the central axis 14, according to my invention. As shown in FIG. 8*a*, the block 72 includes an inlet channel 76 and an outlet channel 78, with the inlet channel 76 being adapted for communicating with the cavity 74 and the inlet 48 of the pump 10, and the outlet channel 78 being adapted for communicating with the cavity 74 and an outlet 46 of the pump 10 in the manner described below.

FIG. 8*a* illustrates the pump 10 installed in the cavity 74 of the block 72. The cavity 74 is internally threaded to receive the threads 54 of the front cover 22. The inlet channel 76 communicates with the bottom of the cavity 74. The outlet channel 78 communicates with a sidewall of the cavity 74. The pump 10 is installed in the cavity 74 by screwing the pump 10 about the central axis 14 into the cavity 74 until the upper and lower o-ring seals 52, 58 seal the cavity 74 and the inlet channel 76 respectively. The lower o-ring 58 seals and separates the low pressure inlet channel 76 from the high pressure portion of the cavity 74 including the outlet channel 78.

Threading the pump 10 into the cavity 74 compresses the upper and lower o-ring seals 52, 58 and applies an initial force through the shoulder 56 and lower o-ring seal 58 for holding the components of the pump 10 securely together. When the pump 10 is operated, the internal pressure in the pump 10 increases, which would tend to separate the front cover 22, gear housing 24 and rear cover 26, absent the unique pressure clamped construction of the pump 10. In conventional pumps, clamping bolts passing through the pump components from top to bottom prevent such separation. In a pressure clamped pump 10, according to my invention, no clamping bolts are used. Rather, the high pressure hydraulic fluid that has been pumped through the pump outlet 46 into the cavity 74 envelopes the lower end 20 of the pump 10. The high pressure fluid acting against the lower end 20 of the pump 10 applies an axial force to the lower end 20 of the pump 10 that forces the rear cover 26, the gear housing 24, and the front cover 22 into tighter sealing contact with one another.

The external area of the pump 10 upon which the pressurized fluid acts is equal to the cross sectional area of the cavity 74 minus the cross sectional area enclosed by the lower o-ring seal 58. The internal axial area on which the high pressure fluid acts is, at most, equal to the area of the gear teeth between the roots and tips of the gears 34, 38. Thus the internal axial area is substantially less than the external axial area, with the result that the pump components are tightly clamped together by the force generated by the pressure of the pumped fluid acting upon the external axial area of the rear cover 26. The clamping force increases as the pump output pressure increases, thus making it possible to eliminate the clamping bolts or other clamping provisions required in pumps of conventional construction, and allowing a pump 10 according to my invention to be considerably more compact and constructed of significantly fewer parts than conventional pumps.

The hydraulic apparatus 70 includes a suitable drive motor 80 mounted on the block 72. As shown in FIG. 8*a*, the motor 80 includes an output drive shaft 89 having an axial bore, or other driving feature such as the specially configured distal end 90, configured to drivingly mate through a drive connection in the form of a coupling 17 with the distal end of the drive shaft 16 of the pump 10. The motor 80 may be any suitable type of motor, such as electric, pneumatic, or any other rotational drive source.

Figure 9A:
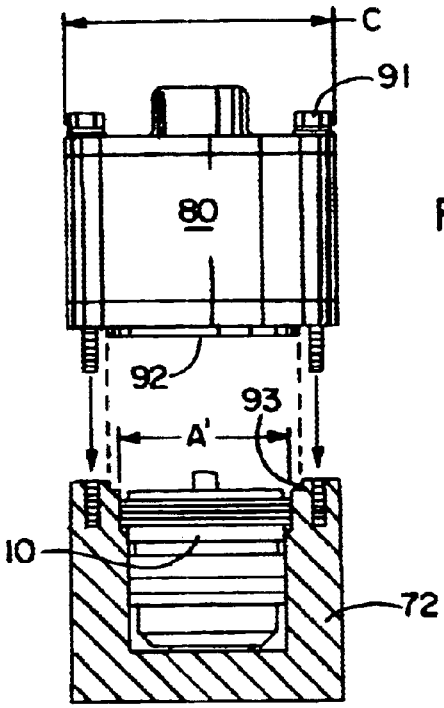
FIGS. 9*a–c* are views of a hydraulic apparatus including a pressure clamped hydraulic pump according to my invention, illustrating advantages provided by my invention as compared to a hydraulic apparatus using prior pressure clamped hydraulic pumps.
Figure 9B:
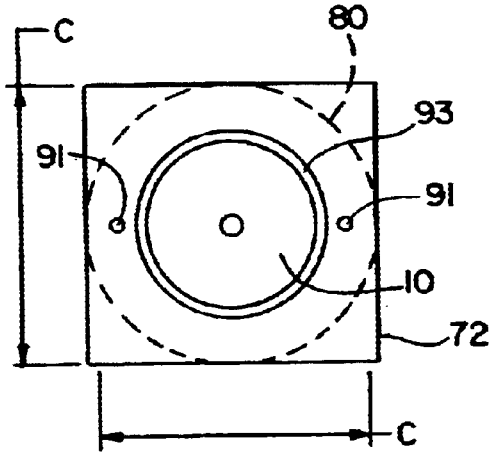
Figure 9C:
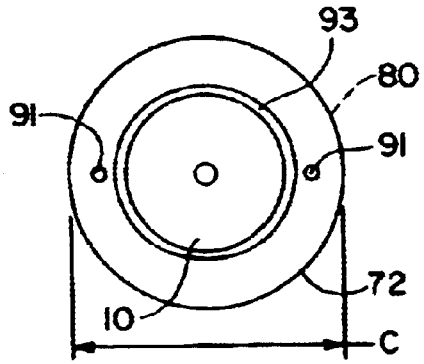

Those having skill in the art will readily recognize that having the pump drive shaft 16 located on the central axis 14 makes alignment of the motor output shaft 89 with the drive shaft 16 much easier than was the case in the prior pressure clamped pump 100 discussed in the background section above, that had the drive shaft 116 offset from the central axis 118 by the distance 'B'. FIGS. 9*a*–9*c* illustrate that for a motor 80 having a housing diameter 'C' driving a pressure clamped pump 10 according to my invention, the pump 10 can be mounted within the footprint of the motor 80, despite the fact that the outer diameter "A'" of the pump 10 is larger than the outer diameter 'A' of the pump 100. This allows the block 72 to be made considerably smaller in dimension than the corresponding block 110 adapted for mounting the prior art pump 100 and motor 122.

Having the drive shaft 16 located on the central axis 14 allows the mounting hardware to be considerably smaller and less complex than that which was required to accommodate the offset 'B' of the drive shaft 116 in the prior pump 100. In fact, where the motor 80 includes through bolts 91 for clamping the motor 80 together, the through bolts 91 are also preferably used for mounting the motor 80 on the block 72, so that the block 72 does not need to be any larger in diameter or linear dimension than the diameter 'C' of the motor 80, the pump and motor mounting means are entirely encompassed within the footprint of the motor 80, as shown by dashed lines in FIGS. 9*a*–*c*. This is particularly advantageous where the block 72 is part of a compact hydraulic apparatus such as the cylindrical shaped housing of a hydraulic cylinder, or is a valve block in a hydraulic valve manifold assembly.

To further facilitate alignment of the motor output shaft 89 with the pump drive shaft 16, the motor 80 includes a pilot 92, and the block 72 includes a piloting recess 93 for receiving the pilot 92, as shown in FIGS. 8*a*, and 9*a–c*. Such a piloting arrangement greatly facilitates installation of the pump 10 and mounting the motor 80 in the hydraulic apparatus 70, and cannot be accomplished in prior pressure clamped pumps 100 having the drive shaft 116 offset from the central axis 118 of the pump 100.

FIG. 8*b* illustrates in schematic form one of many possible embodiments of a hydraulic apparatus 70, or applications for the pump 10 of my invention. In the apparatus shown in FIG. 8*b*, hydraulic fluid is supplied from a reservoir 94 to a valve block 72 via a line 95, where it is drawn into the inlet 46 of a pump 10, installed within a cavity 74 of the valve block 72 and driven by a motor 80 in the manner described above, and pumped under pressure to a hydraulic cylinder 96 via a line 97. Fluid may be returned to the reservoir 94 via return lines 98, 99, and conventional valving means included in the hydraulic apparatus 70 of my invention.

Those having skill in the art will recognize that, while I presently consider it preferable to have the components according to my invention arranged as described above, I contemplate many other arrangements within the scope of my invention. I wish to expressly state that the pump means used in a pump 10 according to my invention may be other types of pumps than the gear pump illustrated in the exemplary embodiments described herein. The pump could, for example, also be configured as a gerotor pump, a vane pump, a centrifugal pump, or any other type of pump receiving a rotating shaft input and suitable for use in the pressure clamped construction described herein.

FIGS. 10 and 11 illustrate another exemplary embodiment of a pressure clamped pump 10 according to my invention that is generally similar in construction to the embodiments described above, but in the pump 10 of FIGS. 10 and 11 a pumping means 23 in the form of a gear pump includes a single primary gear 34 and two secondary gears 38 meshing with and being driven by the primary gear 34. FIG. 12 depicts a similar multiple gear pump 10 having a pumping means 23 in which a single primary gear 34 drives four secondary gears 38.

In the pump 10 embodiment depicted in FIG. 12, the primary gear 34 has a larger pitch diameter with a prime number of gear teeth, (17 as depicted). The prime number of teeth provides more even wear between the primary gear 34 and the secondary gears 38.

Figure 10:
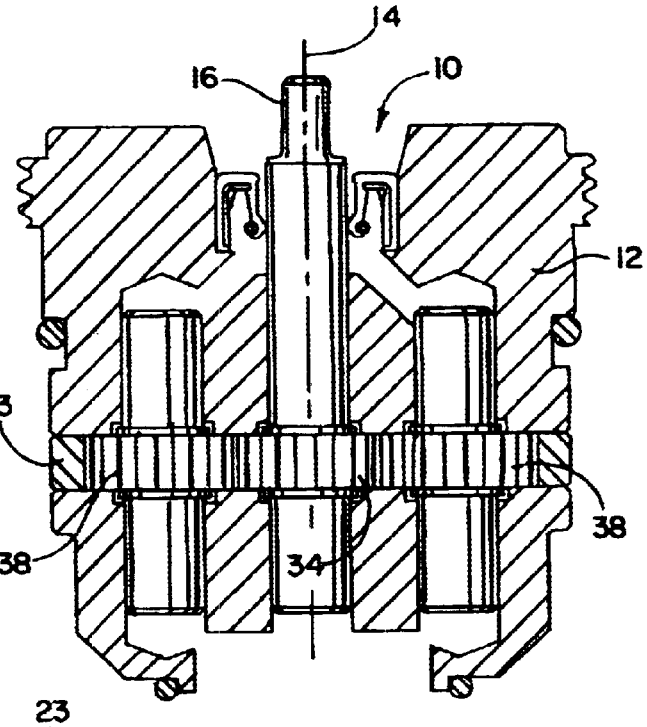
FIGS. 10 and 11 are sectional views of an alternate embodiment of a pump, according to my invention, having a pumping means in the form of a gear pump with a single primary gear driving a pair of secondary gears.
Figure 11:
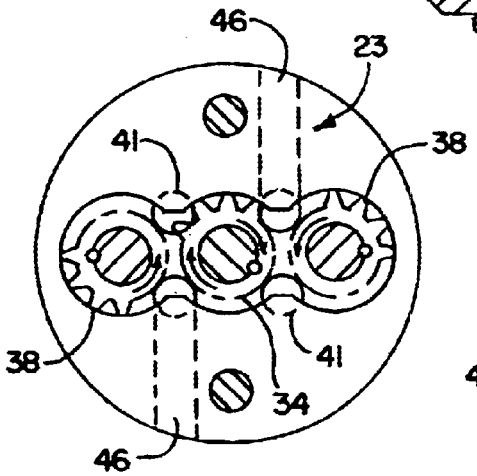
Figure 12:
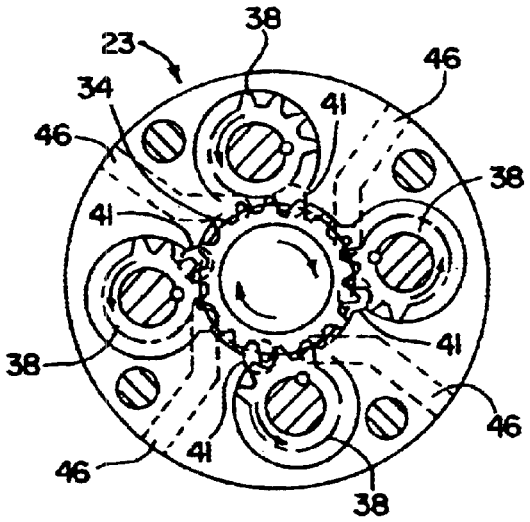
FIG. 12 is a sectional view of a pump according to my invention, having pumping means in the form of a gear pump with a single primary gear driving four secondary gears.

In the embodiments depicted in FIGS. 10–12, the housing 12 defines a central axis 14, and the pump 10 further includes a drive shaft 16 coincident with the central axis 14 of the housing 12. The drive shaft 16 is operatively attached to the primary gear 34 for driving the primary gear 34. A separate inlet 41 and outlet 46 are provided for each secondary gear 38, with the inlets 41 being generally axially directed, and the outlets 46 exiting through the cylindrical periphery of the housing 12.

Moving the drive shaft 16 to the center 14 of the housing 12 provides more room within the housing 12 for additional pumping components, such as the multiple secondary gears 38 depicted in the embodiments of FIGS. 10–12, without increasing the overall diameter of the pump 10 beyond the drive motor 122 footprint 128, as described above. The additional gears 38 allow a pressure clamped pump 10 to be provided that has significantly increased flow and/or pressure, depending upon the inlet/outlet arrangement between the multiple gears 38, in comparison to prior pressure clamped pumps 100 having only a single primary gear driving a single secondary gear 38.

In summary therefore, while the embodiments of my invention disclosed herein are presently considered to be preferred, various changes and modifications can be made without departing from the spirit and scope of the invention. The scope of the invention is indicated in the appended claims, and all changes or modifications within the meaning and range of equivalents are intended to be embraced therein.

I claim:

1. A pressure clamped hydraulic gear pump comprising:

a housing adapted for clamped by hydraulic fluid pressure and adapted for installation into a cavity, the housing defining a center of the housing; and a drive shaft coincident with the center of the housing.

2. The pump of claim 1 wherein the housing is cylindrical and extends from a first to a second end of the housing along an axis coincident with the 10 center of housing.

3. The pump of claim 2 wherein the housing includes threads on an outer periphery thereof, the threads being adapted for threaded installation and retention of the pump along the axis in a cavity having threads configured for mating with the threads on the outer periphery of the housing of the pump.

4. The pump of claim 1 having an inlet coincident with the center of the housing.

5. The pump of claim 1 further comprising means for retaining the drive shaft in the pump.

6. The pump of claim 1 wherein the housing defines a central axis, an inlet and an outlet, the drive shaft extends from the housing along the central axis, and the pump further comprises a plurality of pump components positioned in axially disposed relation to one another, the pump components including:

pumping means located in the housing and operatively connected to the drive shaft for drawing fluid into the inlet at a first pressure and pumping the fluid from the outlet at a second pressure greater than the first pressure, when the drive shaft is rotated about the axis; and means for applying the second pressure to at least some of the pump components to hold the plurality of pump components together in the axially disposed relation without applying a separate clamping force to the components in a direction parallel to the housing axis.

7. The pump of claim 6, wherein the pump components comprise a front cover, a rear cover and a gear housing disposed between the front and rear covers.

8. The pump of claim 7, wherein the pumping means comprises a gear pump having primary and secondary gears meshed with one another.

9. The pump of claim 8 comprising one primary gear and two or more secondary gears, the secondary gears meshing with the primary gear.

10. The pump of claim 9 wherein the primary gear has a prime number of gear teeth.

11. The pump of claim 8, including drive and idler shafts rotatably supported in bores in the front and rear covers, the primary gear being fixed to the drive shaft and the secondary gear being fixed to the idler shaft, the primary and secondary gears being disposed in the gear housing between the front and rear covers.

12. The pump of claim 11, wherein the idler shaft is rotatably supported in one of the bores by a pair of retaining rings engaging the idler shaft on opposite sides of the gear housing.

13. The pump of claim 11, wherein one end of the drive shaft extends through the front cover, the one end having a drive connection and a seal means at the one end for sealing the drive shaft at the front cover.

14. The pump of claim 11 wherein the drive shaft is rotatably retained within one of the bores by a pair of retaining rings engaging the drive shaft on opposite sides of the gear housing.

15. The pump of claim 7, wherein the housing has a first axial area internally of the housing and the second pressure acts upon the first axial area, the rear cover having a second axial area externally of the rear cover greater than the first axial area.

16. The pump of claim 7, wherein the inlet comprises an axially directed opening in the rear cover and the outlet comprises a radial passage in the rear cover.

17. The pump of claim 16, wherein the inlet is disposed coincident with the central axis.

18. The pump of claim 6, wherein the means for applying the second pressure to at least some of the pump components to hold the plurality of pump components together in the axially disposed relation without applying a separate clamping force to the components in a direction parallel to the housing axis comprises a plurality of pins extending through holes in the components.

19. The pump of claim 6, wherein the housing includes an external thread for threadably securing the pump in a cavity.

20. A hydraulic apparatus comprising a block including a cavity and a pressure clamped hydraulic gear pump in the cavity, the pressure clamped hydraulic gear pump having a housing clamped by hydraulic fluid pressure and defining a central axis, the pump further including a drive shaft extending along the central axis, the block further including an inlet channel and an outlet channel, the inlet channel communicating with the cavity and an inlet of the pump, and the outlet channel communicating with the cavity and an outlet of the pump.

21. The hydraulic apparatus of claim 20 wherein the pump further includes a plurality of pump components positioned in axially disposed relation to one another, pumping means located in the housing for drawing fluid into the inlet at a first pressure and pumping the fluid from the outlet at a second pressure greater than the first pressure, the drive shaft extending from the housing along the central axis being operatively connected to the pumping means for drawing fluid into the inlet at a first pressure and pumping the fluid from the outlet at a second pressure greater than the first pressure when the drive shaft is rotated about the central axis, the housing having a first internal axial area upon which the second pressure acts and a second external axial area greater than the first axial area; and the hydraulic apparatus further includes means for sealing the pump inlet and the inlet channel from the pump outlet and the outlet channel such that the second pressure acts upon the second axial area when the pump is operated and applies a clamping force to the housing components.

22. The hydraulic apparatus of claim 21 further comprising a motor connected to the drive shaft for rotating the drive shaft about the central axis.

23. The hydraulic apparatus of claim 20 further including means for aligning an output shaft of a motor with the drive shaft of the pump.

24. The hydraulic apparatus of claim 23 wherein the block includes the means for aligning the output shaft of the motor with the drive shaft of the pump.

25. The hydraulic apparatus of claim 24 wherein the motor includes a pilot disposed coincident with the drive shaft and the block includes a pilot recess disposed coincident with the cavity for receipt of the pilot.

26. The hydraulic apparatus of claim 21, wherein the pump components comprise a front cover, a rear cover and a pumping means housing disposed between the front and rear covers.

27. The hydraulic apparatus of claim 26, wherein the front cover of the pump has an external thread coincident with the central axis and the cavity has an internal thread, the external thread of the front cover being threadably engaged with the internal thread of the cavity.

28. The hydraulic apparatus of claim 26, wherein the sealing means comprises a first O-ring seal mounted on the rear cover around the pump outlet and further including a second O-ring seal mounted on the front cover for sealing the pump in the cavity.

29. The hydraulic apparatus of claim 26, including drive and idler shafts rotatably supported in bores in the front and rear covers, a primary gear fixed to the drive shaft and a secondary gear fixed to the idler shaft, the primary and secondary gears being disposed in the pumping means housing between the front and rear covers.

30. The hydraulic apparatus of claim 29 comprising one primary gear and two or more secondary gears, the secondary gears meshing with the primary gear.

31. The hydraulic apparatus of claim 30 wherein the primary gear has a prime number of gear teeth.

32. The hydraulic apparatus of claim 29, wherein the idler shaft is rotatably supported in one of the bores by a pair of retaining rings engaging the idler shaft on opposite sides of the gear housing.

33. The hydraulic apparatus of claim 29, wherein one end of the drive shaft extends through the front cover, the one end having a drive connection and a seal means at the one end for sealing the drive shaft at the front cover.

34. The hydraulic apparatus of claim 29 wherein the drive shaft is rotatably retained within one of the bores by a pair of retaining rings engaging the drive shaft shaft on opposite sides of the gear housing.

35. The hydraulic apparatus of claim 26, wherein the pump inlet comprises an axial opening in the rear cover and the pump outlet comprises a radial passage in the rear cover.

36. The hydraulic apparatus of claim 35, wherein the pump inlet is coincident with the central axis.

37. The hydraulic apparatus of claim 20, wherein the block is a valve block and the pump supplies pressurized hydraulic fluid to a hydraulic cylinder.

38. The hydraulic apparatus of claim 21, including means for holding the plurality of housing components together in axially disposed relation without applying a clamping force to the components in a direction parallel to the housing axis.

39. The hydraulic apparatus of claim 38 wherein the means for holding the plurality of housing components together in axially disposed relation without applying a clamping force to the components in a direction parallel to the housing axis comprises a plurality of pins extending through holes in the components.

40. A pressure clamped hydraulic gear pump for pumping a fluid, the pump comprising:

a pump housing defining a central axis and including a front cover, a pumping means housing and a rear cover positioned in axially disposed relation to one another, and clamped together with hydraulic fluid pressure, with the rear cover including an inlet and an outlet, the housing being adapted for installation into a cavity;

pumping means located in the pumping means housing for drawing fluid into the inlet at a first pressure and pumping the fluid from the outlet at a second pressure greater than the first pressure;

means for applying the second pressure to at least the rear cover to hold the front cover, pumping means housing and rear cover together in the axially disposed relation, by hydraulic fluid pressure, without applying a separate clamping force to the components in a direction parallel to the housing axis; and a drive shaft extending from the housing along the central axis and operatively connected to the pumping means for drawing fluid into the inlet at a first pressure and pumping the fluid from the outlet at a second pressure greater than the first pressure, when the drive shaft is rotated about the axis.

41. A pressure clamped hydraulic gear pump comprising:

a housing clamped together by hydraulic fluid pressure and defining a central axis of the housing, the housing being adapted for installation into a cavity; and pumping means within the housing having a primary gear and two or more secondary gears meshing with the primary gear, the primary gear having a drive shaft coincident with the central axis of the housing.

42. The pump of claim 41 wherein the primary gear has a prime number of gear teeth.

43. The pump of claim 41 wherein the housing defines a central axis, and the pump further includes a drive shaft coincident with the central axis of the housing.

44. The pump of claim 43 wherein the drive shaft is operatively attached to the primary gear for driving the primary gear.

45. The pump of claim 41 having a separate inlet and outlet for each secondary gear.

46. The pump of claim 45 wherein the housing defines a central axis and an outer generally cylindrical periphery thereof extending generally parallel to the axis, the inlets are generally axially directed, and the outlets exit through the cylindrical periphery of the housing.

* * * * *